US005806098A

United States Patent [19]

McKinnon et al.

[11] Patent Number: 5,806,098

[45] Date of Patent: Sep. 15, 1998

[54] TIE POCKET

[76] Inventors: Robert McKinnon, 2803 Bering Dr., Houston, Tex. 77057; Jolene McMaster, 7 S. Redwing, La Marque, Tex. 77568

[21] Appl. No.: 547,487

[22] Filed: Oct. 24, 1995

[51] Int. Cl.[6] ..... A41D 25/00; A41D 27/20

[52] U.S. Cl. ..... 2/145; 2/144; 2/247; 2/338

[58] Field of Search ..... 2/144, 145, 146, 2/247, 248, 249, 250, 251, 252, 147, 148, 149, 150, 151, 152.1, 153, 154, 155, 156, 157, 338, 310, 311, 312

[56] References Cited

U.S. PATENT DOCUMENTS

| | | | |
|---|---|---|---|
| 517,769 | 4/1894 | Selowsky | 2/144 |
| 1,550,134 | 8/1925 | Whitney | 2/144 |
| 1,960,145 | 5/1934 | Edelheit | 2/145 |
| 2,006,427 | 7/1935 | Wolfson | 2/145 |
| 2,746,055 | 5/1956 | Gleason | 2/145 |
| 3,206,765 | 9/1965 | Sherman | 2/144 |
| 5,073,987 | 12/1991 | Crosier | 2/144 |
| 5,173,968 | 12/1992 | Fox | 2/247 X |
| 5,435,011 | 7/1995 | Nicolai et al. | 2/145 |

*Primary Examiner*—Jeanette E. Chapman
*Attorney, Agent, or Firm*—Wendy K. Buskop; Chamberlain, Hrdlicka et al.

[57] ABSTRACT

The present invention provides for a necktie comprising a wide end with a front side and a back side, a narrow end with a front side and a back side. The necktie has a means for connecting the wide end to the narrow end, and a means for forming a pocket on the back side of the wide end. A method for securing valuables in a pocket attached to the back of a necktie is also provided.

3 Claims, 1 Drawing Sheet

TIE POCKET

BACKGROUND OF THE INVENTION

In one aspect, the present invention relates to a necktie. In another aspect, the invention relates to concealing valuables.

For many decades, common neckties have been formed from a length of decorative cloth, such as silk. The cloth is sewn onto a backing liner. Traditionally, two sections of the cloth are folded over the liner to form the front and back of the necktie. The cloth also has a wide end and a narrow end, with a length between the two ends. Depending upon the fashion of the times, the wide end can be as wide, or much wider than the narrow end. When tied properly, both ends lay, in parallel, across the front (chest) of the person wearing the necktie with the (decorative) front side of the wide end covering the narrow end.

Living in a society with a high crime rate has motivated many people to secure their valuables in different ways. A wallet has become too easy for a criminal to steal. Important items such as driver's license, credit cards, social security card, not to mention cash, are a hot target for many criminals. A way for men to safely carry valuable items on their person would be highly desirable

OBJECTS OF THE INVENTION

It is an object of this invention to provide an article of clothing for concealing valuable items.

It is a further object of this invention to provide a method for concealing valuable items.

SUMMARY OF THE INVENTION

According to the present invention, a necktie is provided with a pocket for concealing valuables. The necktie comprises a wide end with a front side and a back side, and a narrow end with a front side and a back side. The necktie has a means for connecting the wide end to the narrow end, and a means for forming a pocket on the back side of the wide end. A method for securing valuables in a pocket attached to the back of a necktie is also provided.

DETAILED DESCRIPTION OF THE PREFERRED EMBODIMENTS

Figure 2:
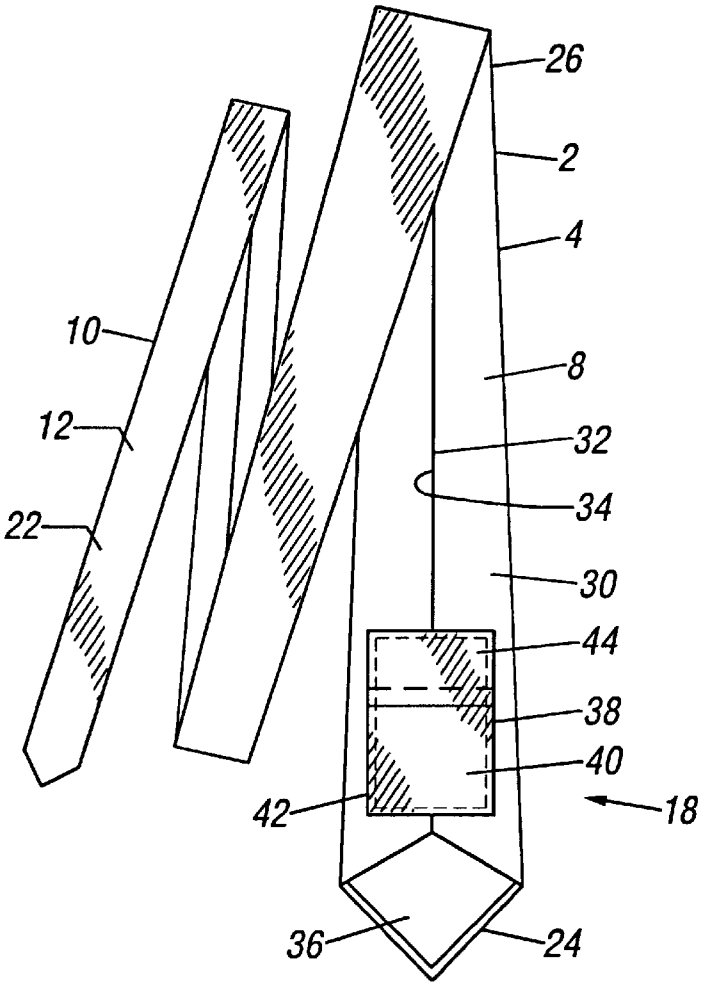
FIG. 2 is a pictorial view of the invention showing the back side of the tie.
Figure 1:
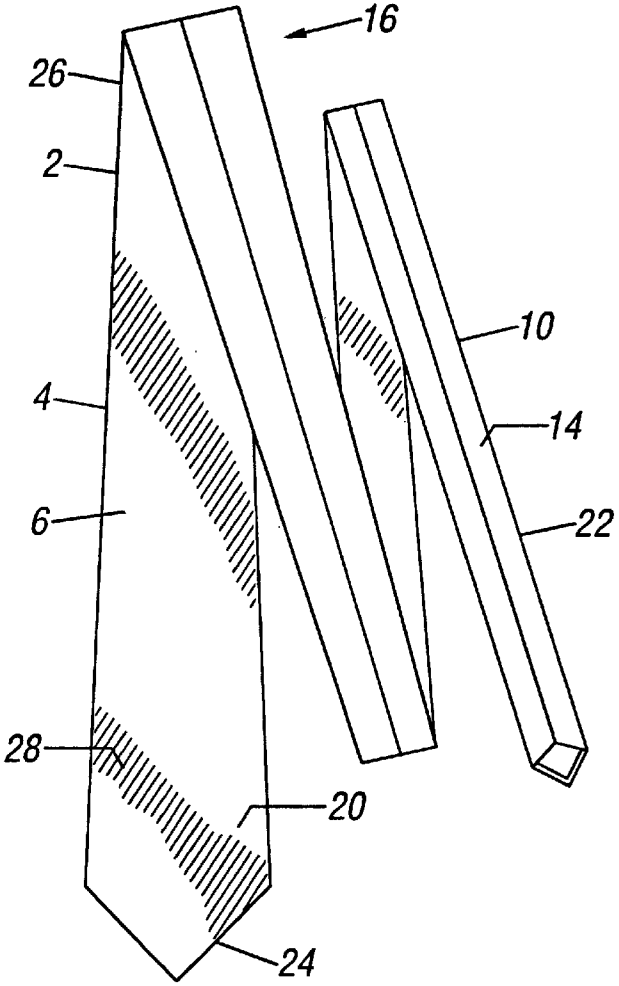
FIG. 1 is a pictorial view of the invention showing the front side of the tie.

As shown in FIGS. 1 and 2, the invention comprises a necktie 2 having a wide end 4 and a narrow end 10. The necktie 2 is made in the typical fashion, with a decorative silk fabric 20 sewn onto a backing liner 36. Before the traditional folding, the fabric 20 and liner 36 have a right edge 32 and a left edge 34. The fabric 20 and liner 36 are folded in two places so that the right edge 32 adjoins the left edge 34 encasing the liner 36 and forming the back side 8 which is opposite the front side 6 as shown in FIGS. 1 and 2. The joined right edge 32 and left edge 34 form a longitudinal axis as shown in FIG. 2. The necktie 2 has a means for connecting the wide end 4 to the narrow end 10. Such connecting means can be a fabric band or a clip.

In the preferred embodiment, the pocket 42 is fixedly attached to the the back side 8. The necktie 2, when tied with a knot as intended (not shown), forms a first region 24 and a second region 26 on the wide end 4. The pocket 42 is fixedly attached to the back side 8 positioned between the first region 24 and the second region 26. Preferably, the pocket 42 is closer to the second region 26 than to the first region 24.

In another embodiment, the means for forming the pocket 42 comprises an outside pocket panel 38 having a front side and a back side, and an inside pocket panel 40 having a front side and a back side. The inside pocket panel 40 is substantially the same size as said outside pocket panel 38. The front side of the inside pocket panel 40 is fixedly attached to the back side 8 near the wide end 4. The outside pocket panel 38 is fixedly attached in superimposed relationship with the inside pocket panel 40 to form pocket 42. The outside pocket panel 38 has a top edge, a bottom edge, a left edge and a right edge. The inside pocket panel 40 also has a top edge, a bottom edge, a left edge and a right edge. The left edge of the outside pocket panel 38 is attached to the left edge of the inside pocket panel 40. The right edge of the outside pocket panel 38 is attached to the right edge of the inside pocket panel 40. The bottom edge of the outside pocket panel 38 is attached to the bottom edge of the inside pocket panel 40. The pocket 42 has a cover flap 44 having a top edge, a bottom edge, a left edge and a right edge. The top edge of the cover flap 44 is attached to the top edge of the inside pocket panel 40. The left edge of the cover flap 44 is attached to the left edge of the inside pocket panel 40. The right edge of the cover flap 44 is attached to the right edge of the inside pocket panel 40 to form a cover for the pocket 42.

In another embodiment of the present invention, there is provided a method for concealing small, flat items in a necktie 2. The method comprises providing a necktie 2 having a wide end 4 and a narrow end 10. The necktie 2 has a front side 6 and a back side 8. The necktie 2 has a means for connecting the wide end 4 to the narrow end 10, and a means for forming a pocket 42 on the back side 8 near the wide end 4. The items to be concealed are placed in the pocket 42.

The forgoing is a description of the arrangement and the operation of embodiments of the invention. The scope of the invention is considered to include the described embodiments together with others obvious to those skilled in the art.

What is claimed is:

1. A necktie consisting of:

a liner;

a decorative cloth fixedly attached to said liner, said cloth having a left edge and a right edge, said cloth folded so that said left edge adjoins said right edge so that said liner is encased in said cloth, said left edge and said right edge of said cloth forming a longitudinal axis, a front side and a back side, a wide end, said wide end having a first region and a second region, a narrow end, a means for connecting said wide end to said narrow end, and a means for forming a pocket on said back side of said wide end, said means for forming a pocket comprising an outside pocket panel having a front side and a back side, and an inside pocket panel having a front side and a back side, said inside pocket panel is substantially the same size as said outside pocket panel, said front side of said inside pocket panel being fixedly attached to said back side of necktie on said wide end, said outside pocket panel being fixedly attached in superposed relationship with said inside pocket panel to form a pocket, and wherein said outside pocket panel has a top edge, a bottom edge, a left edge and a right edge, wherein said left edge of said outside pocket panel is attached to a left edge of said inside pocket panel, said right edge of said outside pocket panel is attached to a right edge of said inside pocket panel, and said bottom edge of said outside pocket panel is attached to a bottom edge of said inside pocket panel, and wherein said pocket further comprises a cover flap having a top edge, a bottom edge, a left edge and a right edge, said top edge of said cover flap being attached to said top edge of said inside pocket panel, said left edge of said cover flap being attached to said left edge of said inside pocket panel and said right edge of said cover flap being attached to said right edge of said inside pocket panel to form a cover for said pocket.

2. A necktie consisting of a liner;

a decorative cloth fixedly attached to said liner, said cloth having a left edge and a right edge, said cloth folded so that said left edge adjoins said right edge so that said liner is encased in said cloth, said left edge and said right edge of said cloth forming a longitudinal axis, a front side and a back side, a wide end, said wide end having a first region and a second region, a narrow end, a means for connecting said wide end to said narrow end, and a means for forming a pocket on said back side of said wide end, said means for forming a pocket comprising an outside pocket panel having a front side and a back side, and an inside pocket panel having a front side and a back side, said inside pocket panel is substantially the same size as said outside pocket panel, said front side of said inside pocket panel being fixedly attached to said back side of necktie on said wide end, said outside pocket panel being fixedly attached in superposed relationship with said inside pocket panel to form a pocket and and wherein said outside pocket panel has a top edge, a bottom edge, a left edge and a right edge, wherein said left edge of said outside pocket panel is attached to a left edge of said inside pocket panel, said right edge of said outside pocket panel is attached to a right edge of said inside pocket panel, and said bottom edge of said outside pocket panel is attached to a bottom edge of said inside pocket panel, and wherein said pocket further comprises a cover flap having a top edge, a bottom edge, a left edge and a right edge, said top edge of said cover flap being attached to said top edge of said inside pocket panel, said left edge of said cover flap being attached to said left edge of said inside pocket panel and said right edge of said cover flap being attached to said right edge of said inside pocket panel to form a cover for said pocket, and wherein said means for connecting said wide and to said narrow end comprises a fabric band.

3. A necktie consisting of:

a liner;

a decorative cloth fixedly attached to said liner, said cloth having a left edge and a right edge, said cloth folded so that said left edge adjoins said right edge so that said liner is encased in said cloth, said left edge and said right edge of said cloth forming a longitudinal axis, a front side and a back side, a wide end, said wide end having a first region and a second region, a narrow end, a means for connecting said wide end to said narrow end, and a means for forming a pocket on said back side of said wide end, said means for forming a pocket comprising an outside pocket panel having a front side and a back side, and an inside pocket panel having a front side and a back side, said inside pocket panel is substantially the same size as said outside pocket panel, said front side of said inside pocket panel being fixedly attached to said back side of necktie on said wide end, said outside pocket panel being fixedly attached in superposed relationship with said inside pocket panel to form a pocket;

and wherein said outside pocket panel has a top edge, a bottom edge, a left edge and a right edge, wherein said left edge of said outside pocket panel is attached to a left edge of said inside pocket panel, said right edge of said outside pocket panel is attached to a right edge of said inside pocket panel, and said bottom edge of said outside pocket panel is attached to a bottom edge of said inside pocket panel, and wherein said pocket further comprises a cover flap having a top edge, a bottom edge, a left edge and a right edge, said top edge of said cover flap being attached to said top edge of said inside pocket panel, said left edge of said cover flap being attached to said left edge of said inside pocket panel and said right edge of said cover flap being attached to said right edge of said inside pocket panel to form a cover for said pocket, and said means for connecting said wide end to said narrow end comprises a clip for fastening to a shirt collar.

* * * * *